US005596773A

United States Patent [19]

Cueman

[11] Patent Number: 5,596,773

[45] Date of Patent: Jan. 28, 1997

[54] WATER LEVEL CONTROL DEVICE

[76] Inventor: Ronald J. Cueman, 2283 Cork Oak St. E., Sarasota, Fla. 34232

[21] Appl. No.: 512,768

[22] Filed: Aug. 9, 1995

[51] Int. Cl.[6] ..... E04H 4/14

[52] U.S. Cl. ..... 4/508; 4/496

[58] Field of Search ..... 4/496, 507, 508

[56] References Cited

U.S. PATENT DOCUMENTS

| | | | |
|---|---|---|---|
| 3,616,918 | 11/1971 | Simsbury | 210/169 |
| 4,342,125 | 8/1982 | Hodge | 4/508 |
| 4,445,238 | 5/1984 | Maxhimer | 4/508 |
| 4,561,133 | 12/1985 | Laing | 4/496 X |
| 4,574,405 | 3/1986 | Tams | 4/508 |
| 4,586,532 | 5/1986 | Tsolkas | 4/508 X |
| 4,607,399 | 8/1986 | Yovanofski | 4/508 |
| 4,621,657 | 11/1986 | St. Ledger | 4/508 X |
| 4,724,552 | 2/1988 | Kinkead et al. | 4/508 |
| 4,735,230 | 4/1988 | Detloff | 4/508 X |
| 4,903,926 | 2/1990 | McNarry et al. | 4/496 X |
| 4,972,530 | 11/1990 | Snyder | 4/508 |
| 5,154,205 | 10/1992 | Langill | 4/508 X |
| 5,203,038 | 4/1993 | Gibbs | 4/508 |

*Primary Examiner*—Robert M. Fetsuga
*Attorney, Agent, or Firm*—Charles J. Prescott

[57] ABSTRACT

A portable swimming pool water level maintenance device for releasible attachment to a swimming pool having a built-in skimmer. The device includes an upright conduit open at each end and having a conventional toilet ball cock valve and vertically slidable float assembly mounted therewithin. The water inlet of the valve is connectable to the water discharge end of a garden hose, fill water being supplied from the garden hose through the valve to raise the water level sufficiently for the float to close the valve. The conduit is held in upright orientation and vertical position by three spaced, parallel elongated horizontal support members and an elongated upright support member connected to the side of the conduit and arranged to releasibly engage against the deck, inside upper surface of the skimmer and the pool wall surface just below the skimmer. A small visual flow outlet discharges some of the water flowing into the valve out from above the pool water level to visually advise of when the valve is open and the pool is being filled.

2 Claims, 2 Drawing Sheets

WATER LEVEL CONTROL DEVICE

BACKGROUND OF THE INVENTION

1. Scope of Invention

This invention relates generally to water level control devices for swimming pools, and more particularly to a portable device for maintaining swimming pool water level which is releasibly engageable with the swimming pool skimmer.

2. Prior Art

Modern swimming pools lose water in several ways on a daily basis. Swimming pool water is lost through evaporation, splashing the water out of the pool, leaks in the swimming pool lining and drain valves and leaks in the water filtration system. The water lost in these ways must be replenished on a frequent basis so as to maintain a desired water level in the swimming pool.

Maintaining this desired water level is of utmost importance in maintaining pool cleanliness as built-in skimmers positioned at the desired water level function most efficiently, if at all, in removing debris from the water surface when the swimming pool water is at the desired height.

One simple method of maintaining swimming pool water level is to periodically simply manually open a fill valve or a garden hose so as to flow fresh water into the pool. Applicant is also aware of a number of patented prior art devices which are intended to accomplish a similar function automatically as listed below:

| Inventor | Patent No. |
|---|---|
| Gibbs | 5,203,038 |
| Yovanofski | 4,607,399 |
| Tams | 4,574,405 |
| Hodge | 4,342,125 |
| St. Ledger | 4,621,657 |
| Kinkead, et al. | 4,724,552 |
| Snyder | 4,972,530 |
| Diemond, et al. | 3,616,918 |
| Maxhimer | 4,445,238 |

However, none of these devices provide a portable system for releasible engagement with the skimmer which is connectable to the discharge end of a conventional garden hose. The present invention providing such features is also very economical to manufacture, preferably utilizing a toilet ball cock valve and float assembly to control water flow and p.v.c. tubular components.

BRIEF SUMMARY OF THE INVENTION

This invention is directed to a portable swimming pool water level maintance device for releasible attachment to a swimming pool having a built-in skimmer. The device includes an upright conduit open at each end and having a conventional toilet ball cock valve and vertically slidable float assembly mounted therewithin. The water inlet of the valve is connectable to the water discharge end of a garden hose, fill water being supplied from the garden hose through the valve to raise the water level sufficiently for the float to close the valve. The conduit is held in upright orientation and vertical position by three spaced, parallel elongated horizontal support members and an elongated upright support member connected to the side of the conduit and arranged to releasibly engage against the deck, inside upper surface of the skimmer and the pool wall surface just below the skimmer. A small visual flow outlet discharges some of the water flowing into the valve through a separate tube positioned above the pool water level to visually advise of when the valve is open and the pool is being filled.

It is therefore an object of this invention to provide a portable swimming pool water level control device for automatically maintaining a desired swimming pool water level which is easily engageable between the deck and a built-in skimmer of the swimming pool for temporary or more permanent use.

It is yet another object of this invention to provide a portable swimming pool water level control device which is easily adaptable in a single form to a wide range of swimming pool designs and built-in skimmer dimensions.

It is yet another object of this invention to provide a portable swimming pool water level control device utilizing a conventional toilet ball cock valve and vertical float assembly connectable to the discharge end of a conventional garden hose.

In accordance with these and other objects which will become apparent hereinafter, the instant invention will now be described with reference to the accompanying drawings.

DETAILED DESCRIPTION OF THE INVENTION

Figure 2:
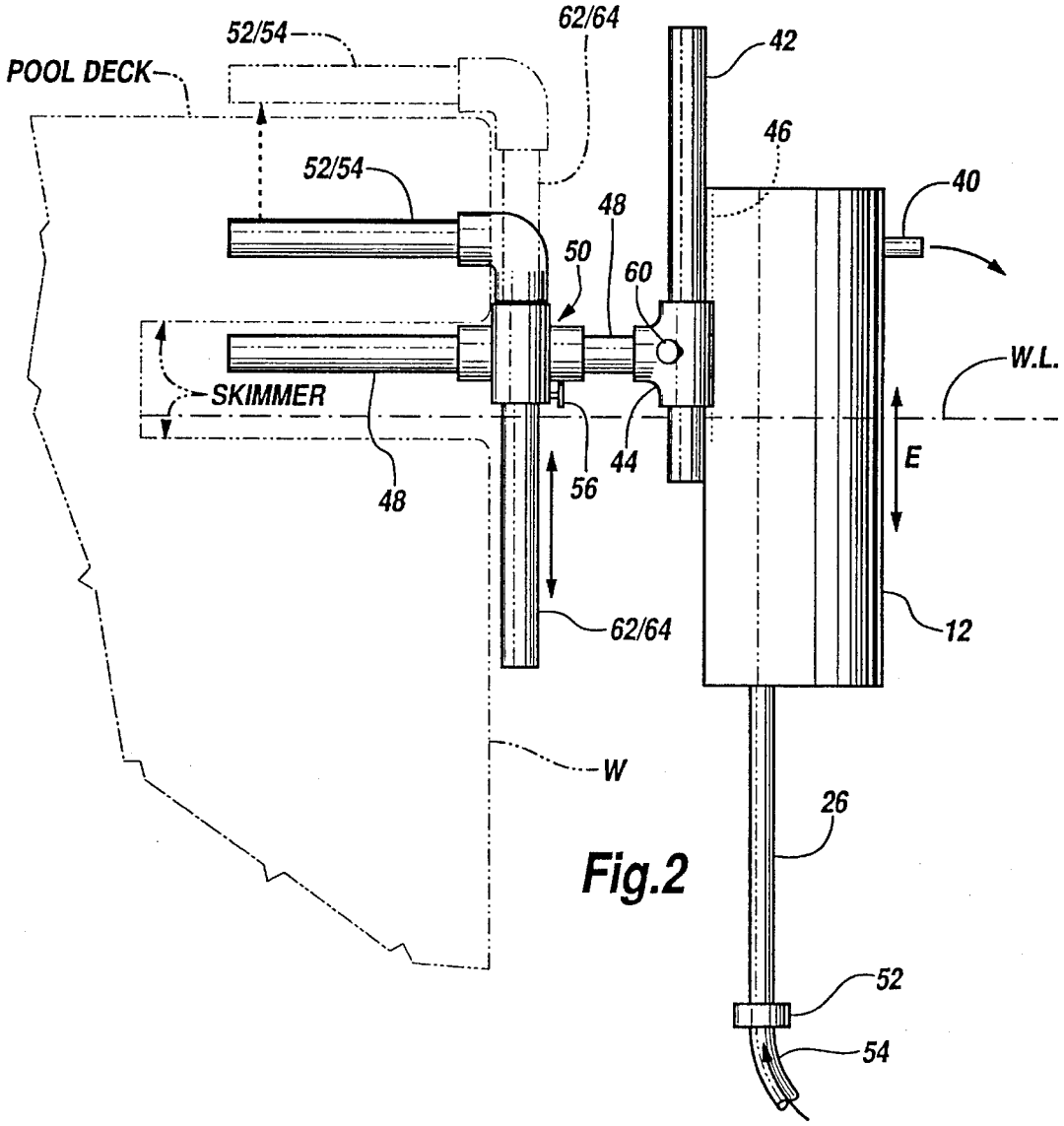
FIG. 2 is a side elevation view of FIG. 1.
Figure 3:
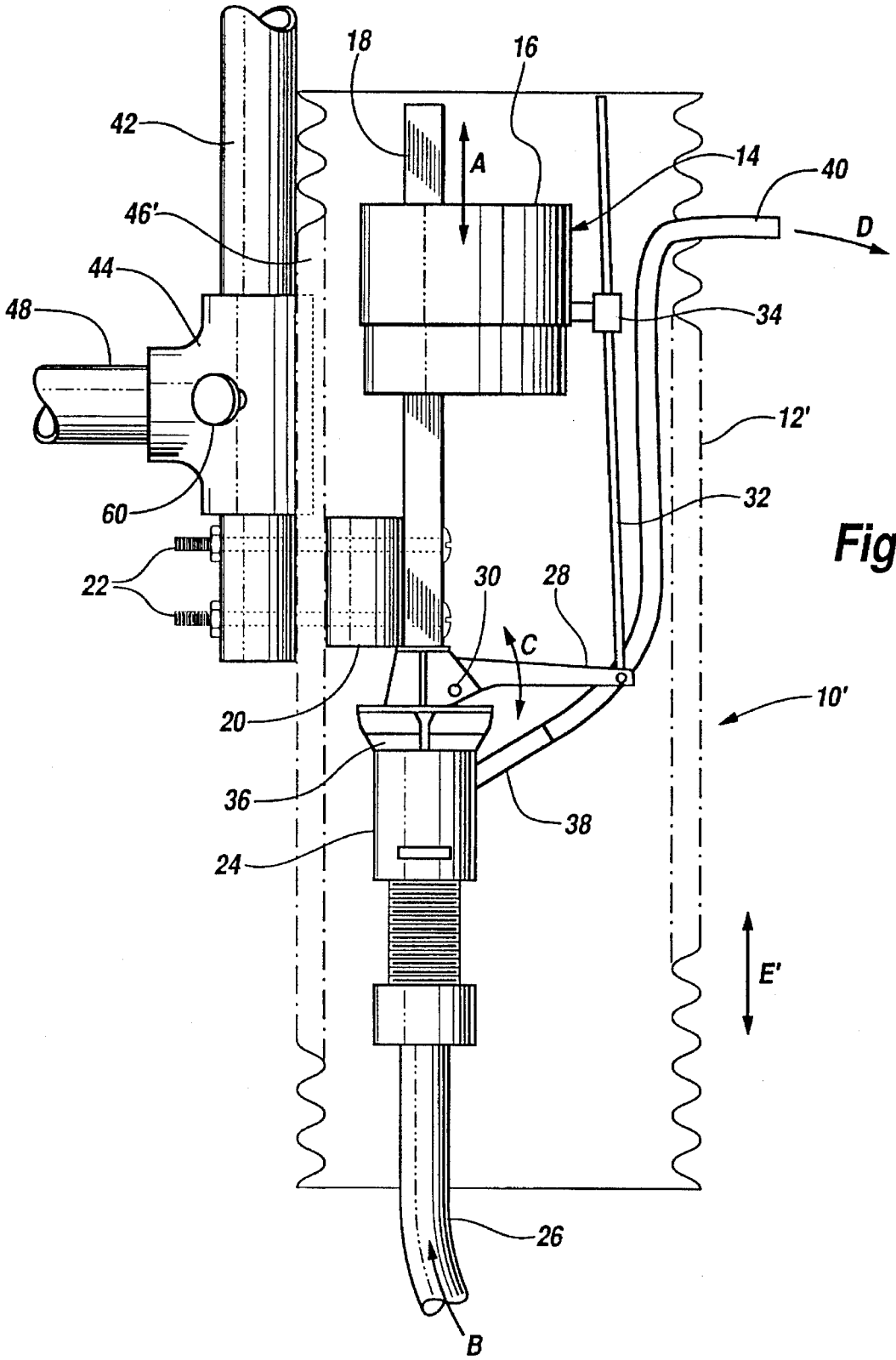
FIG. 3 is a side elevation broken view of another embodiment of the invention.

Referring now to the drawings, one embodiment of the invention is shown generally at numeral 10 and includes a conventional toilet ball cock valve and vertical float assembly 14 shown in detail in FIG. 3. The valve assembly 14 includes an upright valve 24 extended at its lower end by flexible conduit 26 and connectable by threaded fitting 52 to discharge end 54 of a conventional garden hose as shown in FIG. 2.

The valve 24 is held in position by elongated upright member 18 being rigidly connected and spaced from an inner surface of an elongated tubular conduit 12 by a tubular spacer 20 and threaded fasteners 22. One embodiment of the elongated conduit 12 is formed by conventional p.v.c. tubing open at either end. The other conduit embodiment 12' is formed of ribbed plastic conduit material.

A generally cylindrical float 16 of each embodiment 10 or 10' is slidably engaged on upright guide member 18 through a longitudinal mating opening formed through the float 16. By this arrangement, when float 16 is moved in the direction of arrow A relative to valve 24, adjustable arm 32 acting on shut off valve lever 28 in the direction of arrow C opens and closes valve 24 in a well-known manner.

When the valve 24 is opened by downward displacement of float 16 an lever 28, water discharges through outlets 36 and through tube 38. Thus, a portion of the inlet water exits through flexible tube 40 which extends laterally from a hole formed in the upper side of the conduit 12. Being positioned well above the water level W.L., flexible tube 40 provides a this discharge stream that is an easily visible indication that the pool is being filled.

To support and maintain a desired orientation and vertical positioning of the conduit 12 or 12' with toilet ball cock assembly 14 secured therewithin as above described, an upright length of plastic tubing 42 is rigidly connected by threaded fasteners 22 and extending longitudinally along the side of the conduit 12 or 12' as best seen in FIG. 3. Clearance slots 46 and 46', which extend longitudinally from the upper end of conduit 12 or 12', are provided as clearance for t-fitting 44. A horizontal tubular member 48 extends by t-fitting 44, radially away from the conduit 12 or 12' to interengage with a support assembly 50 having three parallel, elongated slender horizontal support members 48, 52 and 54 held in the respective positions shown by the conventional p.v.c. cross fittings and elbows shown. Horizontal support members 52 and 54 are vertically adjustably positionable as shown in FIG. 2 with respect to support member 48 and held in any desired spacial adjustment by threaded screws 56 and 58. The lower support member 48 thus engages into the skimmer to contact the upper inner surface thereof while the upper support members 52 and 54 contact against the pool deck surface by downward adjustment and securement thereof as previously described so as to tightly span against these corresponding pool surfaces. The upright legs 62/64 contact against the wall surface W of the swimming pool immediately below the skimmer so as to stabilize the conduit from tipping or rotation away from the wall W.

Figure 1:
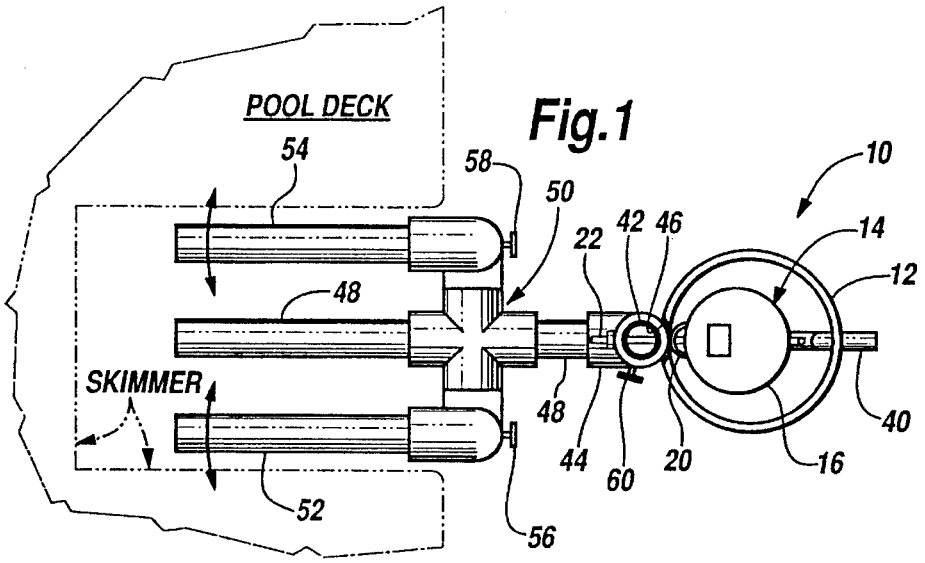
FIG. 1 is a top plan view of one embodiment of the invention positioned in conjunction with a pool deck and skimmer of a swimming pool shown in phantom.

In FIG. 3, all of the components are identical to that with respect to FIGS. 1 and 2 except that this embodiment 10' includes a ribbed plastic conduit member 12' in lieu of a smooth surface p.v.c. tubing 12 of FIGS. 1 and 2 as previously described.

Water level W.L. adjustment to a predetermined or desired level is accomplished in two ways. The entire conduit 12 or 12' may be adjusted vertically in the direction of arrow E or E' in FIGS. 2 and 3, respectively, and secured by thumb screw 60. Alternately, the float 16 may be repositioned vertically along guide member 18 by releasing spring clamp 34 on arm 32 while effecting the repositioning.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable swimming pool water level control device, the swimming pool having a built-in recess defining a skimmer positioned in a wall of the swimming pool at the desired water level of the swimming pool and slightly lower than the level of a deck of the swimming pool, said control device comprising:

a straight tubular upright conduit having open ends;

a toilet ball cock valve and vertically slidable float assembly connected within said conduit, said valve having a water inlet and outlet, said float opening and closing said valve responsive to relative height positioning between said valve and said float;

said inlet connectable to a water discharge end of a garden hose, another end of the garden hose connectable to a water supply;

three spaced, parallel elongated slender horizontal support members connected to and laterally extending away from said conduit;

said horizontal support members spaced apart to supportively and cooperatively engage against an upper surface inside the skimmer and the pool deck whereby the conduit is held upright and positioned vertically in the swimming pool adjacent the skimmer at the desired water level;

an upright support extending downwardly from said horizontal support members to engage against the wall of the swimming pool below the skimmer to prevent rotation of said conduit away from the wall;

said float moving vertically with respect to said valve responsive to the swimming pool water level to open said valve when pool water level drops below a preselected level established by vertical positioning of said float.

2. A water level control device as set forth in claim 1, further comprising:

visual water flow means having an outlet above the pool water level for determining when said valve is open and water is flowing through said valve into the swimming pool.

* * * * *